US008079177B1

(12) United States Patent
Regner

(10) Patent No.: US 8,079,177 B1
(45) Date of Patent: Dec. 20, 2011

(54) BETTY'S ROSE SAVER FRESH FLOWER HOLDER

(76) Inventor: William R Regner, Austin, MN (US)

( * ) Notice: Subject to any disclaimer, the term of this patent is extended or adjusted under 35 U.S.C. 154(b) by 0 days.

(21) Appl. No.: 12/950,168

(22) Filed: Nov. 19, 2010

(51) Int. Cl.
*A47G 7/00* (2006.01)

(52) U.S. Cl. ..... 47/41.15; 47/41.01; 47/41.14

(58) Field of Classification Search ..... 47/41.01, 47/41.1, 41.11, 41.12, 41.13, 41.14, 41.15
See application file for complete search history.

(56) References Cited

U.S. PATENT DOCUMENTS

| | | | | | |
|---|---|---|---|---|---|
| 674,116 | A | * | 5/1901 | Kift | 47/41.11 |
| 1,566,794 | A | | 12/1925 | Harper | |
| 2,520,818 | A | * | 8/1950 | Terry | 248/153 |
| 2,583,001 | A | | 1/1952 | Magers | |
| 2,639,552 | A | | 5/1953 | Tredup | |
| 2,994,424 | A | | 8/1961 | Selby | |
| 3,127,011 | A | * | 3/1964 | Weddle | 206/423 |
| 3,899,100 | A | * | 8/1975 | Rigaud | 220/229 |
| 4,094,096 | A | * | 6/1978 | Huyssen | 47/41.13 |
| 4,221,078 | A | | 9/1980 | Latham | |
| 4,640,045 | A | | 2/1987 | Nesbitt | |
| 4,811,841 | A | | 3/1989 | Domenichiello | |
| 4,941,572 | A | | 7/1990 | Harris | |
| 5,136,805 | A | | 8/1992 | Mookherjee | |
| 5,687,469 | A | | 11/1997 | Weder | |
| 6,092,330 | A | | 7/2000 | Pratt | |
| 6,119,394 | A | | 9/2000 | Fowler | |
| 6,128,855 | A | | 10/2000 | Salamh | |
| 6,202,345 | B1 | | 3/2001 | Wokal | |
| 6,250,912 | B1 | * | 6/2001 | Widdowson | 431/324 |
| 6,289,630 | B1 | | 9/2001 | Hetze | |
| 6,712,209 | B2 | | 3/2004 | Story | |
| D574,670 | S | * | 8/2008 | Grady | D7/620 |
| D618,074 | S | * | 6/2010 | Paetsch | D7/701 |
| 2008/0230409 | A1 | * | 9/2008 | Elfezouaty | 206/223 |

* cited by examiner

*Primary Examiner* — Frank T Palo

(57) ABSTRACT

A flower holder keeps a flower looking fresh during a long period of time, under adverse weather conditions with temperatures under 40° Fahrenheit. The flower holder includes a rod with one of its ends inserted into the ground, at least one ring holder connected to the vertical rod, an elongated tube including a cap on each end, the elongated tube slides through the ring holder.

7 Claims, 2 Drawing Sheets

BETTY'S ROSE SAVER FRESH FLOWER HOLDER

BACKGROUND OF THE INVENTION

The present invention generally relates to a fresh flower holder. More specifically, the present invention relates to a fresh flower holder for graveside use that keeps the flower looking fresh as long as the temperature stays under 40°.

It is customary to place flowers near a gravestone. Typically, a holder having the flowers is placed at the graveside. Unfortunately, the flowers placed at a graveside are easily scattered by the wind or adverse weather conditions, quickly losing their attractiveness.

As can be seen, there is a need for a flower holder that keeps the flowers looking fresh during long periods of time, even under adverse weather conditions.

SUMMARY OF THE INVENTION

In one aspect of the present invention, the Betty's Rose Saver Fresh Flower Holder includes a rod with one of its ends inserted into the ground, at least one ring holder connected to the vertical rod, an elongated tube including a cap on each end the elongated tube slides through the ring holder.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a flower holder that may keep a flower looking fresh during a long period of time under adverse weather conditions where temperatures remain below 40° Fahrenheit.

Figure 1:
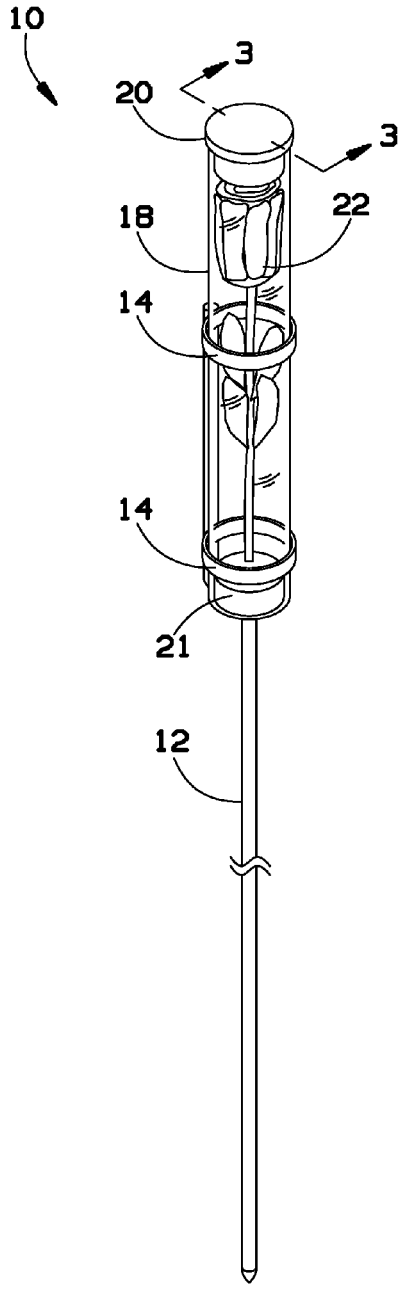
FIG. 1 illustrates a perspective front view of the flower holder according to an exemplary embodiment of the present invention showing the flower inside the holder.
Figure 2:
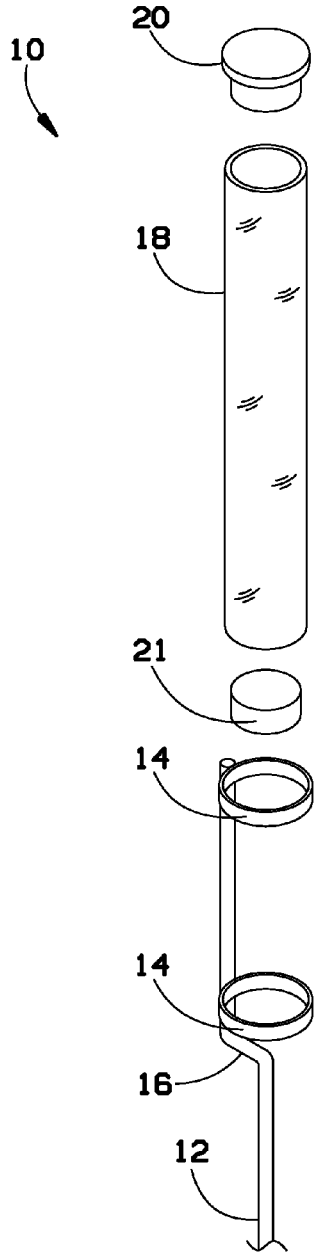
FIG. 2 illustrates an exploded view of the flower holder of FIG. 1.
Figure 3:
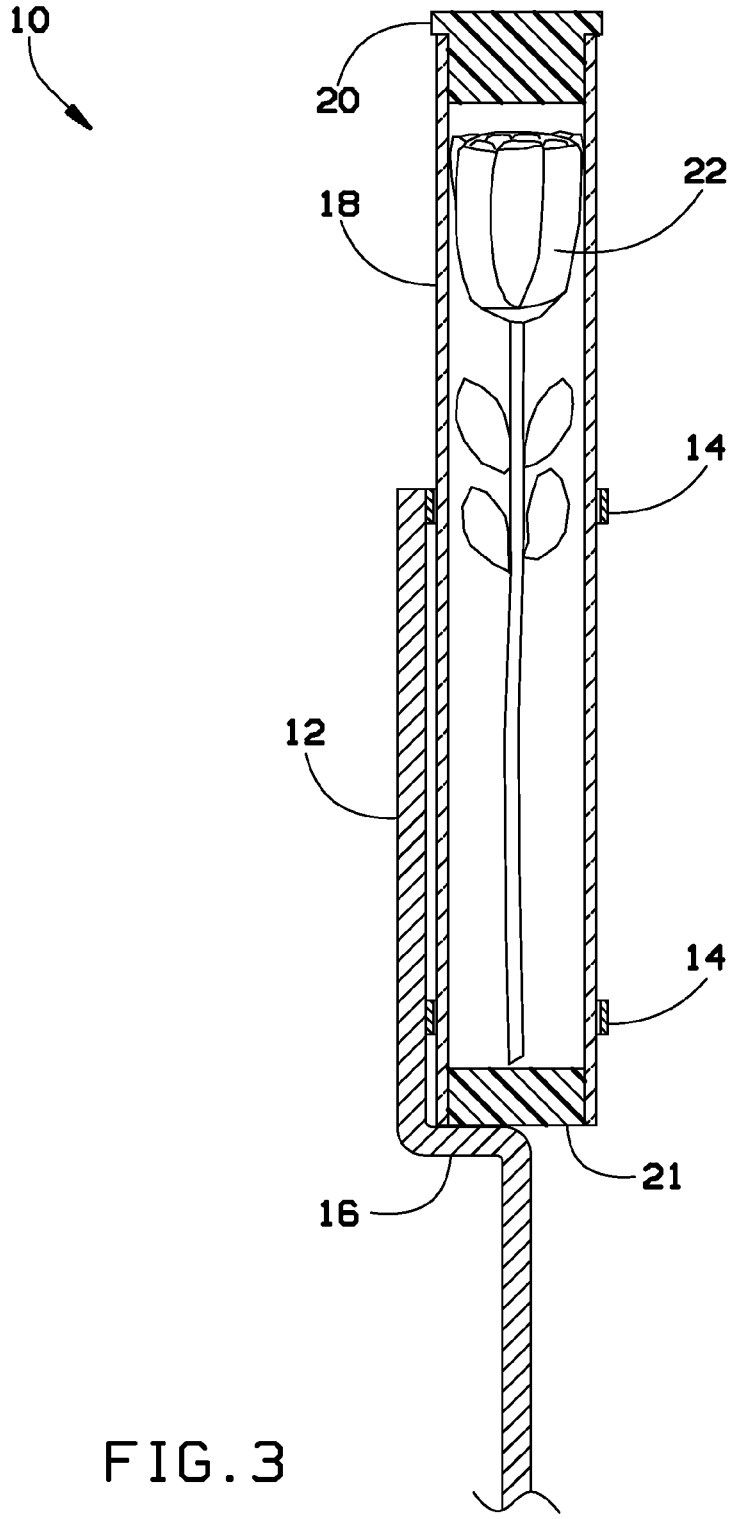
FIG. 3 illustrates a cross sectional view of the flower holder of FIG. 1 taken along lines 3-3.

FIGS. 1-3 illustrate the flower holder 10 according to an exemplary embodiment of the present invention. The flower holder 10 may include a vertical rod 12, at least one ring holder 14 connected to the vertical rod 12, an elongated tube 18, a first removal cap 20, and a second removable cap 21. In one embodiment has a permanent cap 21.

The vertical rod 12 may be made of a sturdy material. In one embodiment, the vertical rod 12 may be made of metal or plastic. In one embodiment, the vertical rod 12 may be made of stainless steel. The length and diameter of the vertical rod 12 may depend on the user's preferences. In one embodiment, the length of the vertical rod 12 may be 36 inches and the diameter may be 5/16 of an inch. The lower end of the vertical rod 12 is adapted to be inserted into the ground. The vertical rod 12 may have a pointed lower end to facilitate its insertion into the ground.

The vertical rod 12 may include a bend 16 for holding the lower end of the elongated tube 18. The bend 16 may be an L-shaped bend. The bend 16 may be located towards the center of the rod. In one embodiment, the bend 16 may be located at 28 inches from the top end of the vertical rod 12.

The ring holder 14 may be made of the same material as the vertical rod 12. The ring holder 14 may be connected to the vertical rod 12 by welding, gluing, or heating. In one embodiment, the ring holder 14 may be an integral part of the vertical rod 12. The diameter of the ring holder 14 may depend on the size of the elongated tube 18. In one embodiment, the ring holder 14 may have a 2 inch diameter.

In one embodiment the flower holder 10 may include two ring holders 14 vertically spaced. The first ring holder 14 may be placed near the top end of the vertical rod 12. The second ring 14 may be placed near the bend 16 of the vertical rod 12.

The elongated tube 18 may be made of a clear plastic material. In one embodiment, the elongated tube 18 may be made of clear polyvinyl chloride (PVC). The diameter of the elongated tube 18 may depend on the diameter of the ring holder 14. In one embodiment, the diameter of the elongated tube 18 may be between 1½ to 1¾ inches. The length of the elongated tube 18 may depend on the length of the vertical rod 12. In one embodiment, the length of the elongated tube 18 may be 12 inches. The thickness of the wall of the elongated tube 18 may depend on the length of the elongated tube 18. In one embodiment, the thickness of the wall of the elongated tube 18 may be ⅛ of an inch.

The first cap 20 may be connected to the top end of the elongated tube 18. The second cap may be permanently attached to the bottom end of the elongated tube 18. The caps 20 and 21 may be made of an elastic material. In one embodiment, the caps 20 and 21 may be made of polyvinyl chloride. The diameter of the caps 20 and 21 may depend on the diameter of the elongated tube 18. The walls of the caps 20 and 21 may be tapered to help the insertion into the elongated tube 18. The first cap 20 and the second cap 21 may include a lip around its rim to facilitate its removal from the elongated tube 18. In one embodiment the second cap may not have a lip making it more permanent The pointed end of the vertical rod 12 may be inserted in the ground near the gravesite as far into the ground as needed to make it stable. The user may place the flower 22 inside the elongated tube 18 and may insert the first cap 20 into the top end of the elongated tube 18. Finally, the user may slide the elongated tube 18 through the ring holders 14 until the lower end of the elongated tube 14 rests on the bend 16 of the vertical rod 12.

Before placing the flower into the tube, the user may trim the end of the flower 20 stem by ¼ inch to make sure that there is at least a 1 inch gap between the flower 22 and the first cap 20. In addition, the user may not add water to the elongated tube 18. In one embodiment the user would not add water to the elongated tube.

As long as the temperature stays below 40° F., the condensation from the sun heat and the cold weather may produce the necessary water inside the sealed elongated tube 12 for the flower to stay fresh.

When the temperature gets above 40° F., the user may remove the flower 22 from the flower holder 10 and clean the flower holder 10. While the temperature is above 40° F., the user may place an artificial flower, picture, small cross, angel or other memorial inside the elongated tube 18.

It should be understood, of course, that the foregoing relates to exemplary embodiments of the invention and that modifications may be made without departing from the spirit and scope of the invention as set forth in the following claims.

I claim:

1. A flower holder comprising:

a rod having a first end and a second end, wherein the first end of the vertical rod is inserted into a ground surface;

at least one ring holder connected to the second end of the vertical rod;

an elongated tube having a top end and a bottom end;

a first removable cap connected to the top end of the elongated tube;

a second permanent cap connected to the bottom end of the elongated tube;

wherein the elongated tube is made of a clear plastic; and wherein the elongated tube is adapted to slide through the ring holder.

2. The flower holder of claim 1, wherein the vertical rod includes a pointed lower end.

3. The flower holder of claim 1, wherein the vertical rod has a bend near the middle of the rod.

4. The flower holder of claim 1, wherein the bend is an L-shaped bend.

5. The flower holder of claim 1, wherein the flower holder includes two ring holders vertically spaced.

6. The flower holder of claim 1, wherein the ring holder is integrated to the vertical rod.

7. The flower holder of claim 1, wherein the ring holder is welded to the vertical rod.

* * * * *